US008231483B2

(12) United States Patent
Gill

(10) Patent No.: US 8,231,483 B2
(45) Date of Patent: Jul. 31, 2012

(54) MULTIPURPOSE GOLF DIVOT TOOL

(76) Inventor: Ryan Douglas Gill, East Wenatchee, WA (US)

( * ) Notice: Subject to any disclaimer, the term of this patent is extended or adjusted under 35 U.S.C. 154(b) by 160 days.

(21) Appl. No.: 12/610,177

(22) Filed: Oct. 30, 2009

(65) Prior Publication Data

US 2010/0113175 A1 May 6, 2010

(51) Int. Cl.
*A63B 57/00* (2006.01)

(52) U.S. Cl. ..... 473/408

(58) Field of Classification Search ..... 473/408, 473/286; D21/793
See application file for complete search history.

(56) References Cited

U.S. PATENT DOCUMENTS

| | | | | | |
|---|---|---|---|---|---|
| D247,686 | S * | 4/1978 | Desjardins | D21/793 |
| D290,985 | S * | 7/1987 | Dikoff | D21/793 |
| 5,226,647 | A * | 7/1993 | Notarmuzi | 473/284 |
| 5,529,299 | A * | 6/1996 | Bellagamba | 473/285 |
| 6,224,502 | B1 * | 5/2001 | Warfield | 473/408 |
| 6,546,981 | B2 * | 4/2003 | Cameron | 150/160 |
| 6,565,458 | B1 * | 5/2003 | Cameron | 473/408 |
| D493,859 | S * | 8/2004 | Lee | D21/793 |
| D502,242 | S * | 2/2005 | Cameron | D21/793 |
| 7,238,126 | B1 * | 7/2007 | Wiens et al. | 473/408 |
| D580,001 | S * | 11/2008 | McCabe | D21/793 |
| 7,527,563 | B1 * | 5/2009 | Neu | 473/282 |
| 7,942,756 | B1 * | 5/2011 | Neu | 473/282 |
| 2002/0115507 | A1 * | 8/2002 | Gribovsky | 473/406 |
| 2004/0023733 | A1 * | 2/2004 | Tummillo | 473/406 |
| 2004/0248674 | A1 * | 12/2004 | Bauley et al. | 473/406 |
| 2006/0063614 | A1 * | 3/2006 | Bellagamba | 473/408 |
| 2009/0163300 | A1 * | 6/2009 | Lueders | 473/408 |
| 2011/0201456 | A1 * | 8/2011 | Schaaf | 473/408 |

* cited by examiner

*Primary Examiner* — Steven Wong
(74) *Attorney, Agent, or Firm* — Donn K. Harms

(57) ABSTRACT

A multi purpose golf tool adapted for repair for pitch mark type depressions in turf of a golf course. The tool employs an angled engagement of a handle and forks to a body to obtain mechanical advantage for forcing turf upward to repair turf depressions. A bottle opener and pop top opener are also provided. The device is also adapted to hold a cigar and to maintain a club shaft in an elevated position above the turf using an arched engagement of a handle end.

12 Claims, 3 Drawing Sheets

MULTIPURPOSE GOLF DIVOT TOOL

BACKGROUND OF THE INVENTION

1. Field of the Invention

The invention herein disclosed relates generally to the playing of golf. More particularly it relates to a multipurpose device providing the user a means for easier pitch mark repair, along with a number of other uses valuable to golfers during a conventional round of golf.

2. Prior Art

During a round of golf, it is inevitable that a player will cause a divot in the turf at the course. Divots, as is well known, are imperfections formed in the turf of the course which are caused by the club head during a swing. When formed as depressions in the turf, by the compaction of the club head against the turf and soil, a pitch mark is formed and can cause the ball roll to vary from what is intended, and cause the turf itself to discolor or die due to compaction of the soil and root system. Additionally, with high flying approach shots, players inevitably cause pitch marks or dents in the green from ball impacts. Whether from club impact, or ball impact, pitch marks can play havoc with the putting portion of the game, and can cause turf problems.

With hundreds or even thousands of golfers traversing the golf course each week, the number of pitch marks and divots caused by each golfer, multiplied by the large number of players on the course, have the potential for ruining the turf of the course if not reasonably repaired. It is thus proper golf etiquette for any player to take the time and effort to repair any divots caused by their shot during a round. This is done by replacing the torn turf. Golf etiquette also calls for golfers to repair pitch marks in the green by prying the turf back to a substantially level condition relative to the surrounding turf.

Divot repair tools have been available for use by golfers for many years and are a device that most every golfer should carry during a round of golf to aid them in their repairing of divots. Conventional divot repair tools are often formed of metal or rigid plastic and are adapted to include a body portion from which an elongated member or members extend in one direction and frequently a handle in the other.

In use, a divot repair tool is manipulated to insert one end of the tool into the soil or underlying turf on a fairway or a green, to both aerate the roots, and in a second action, to pry up the dented overlying surface forming the pitch mark following a shot where the club, or a high flying ball, impacted the ground. If done correctly, the turf will appear fairly normal and will continue to grow well and browning will be minimized. If all golfers are so considerate, the fairways and especially the greens on golf courses remain well maintained and in reasonably good condition.

Many such tools exist, most being a planar member with a forked end having a straight central axis extending between to aligned ends. The forks or a first end are inserted and once in the soil, the rear of the member is pushed downward. Depending on the soil conditions and the depth of the divot, the amount of force can be considerable for a person with limited arm or hand strength. Being planar or essentially straight, such tools need to be inserted a distance into the soil at an angle to place the distal ends of the forks in the correct position for prying upward. This can increase the strength required to both insert the forks such a distance, and to then rotate the forks upward to lift the divot once so inserted.

However, even with a proper design to allow use with less force, golfers dislike being loaded down with multiple tools and components to take with them during a round of golf because they must be carried in limited space and too many devices take too much space and easily get lost or disorganized. Consequently, a golf divot repair tool that provides numerous functions, and works especially well for the primary purpose of divot repair would be especially welcomed by golfers trying to limit what they carry with them during a round.

As such, there is an unmet need for a divot repair tool for golfers which is of improved mechanical design such that it decreases the amount of force required by users to lift a divot. Such a divot tool should, in addition to lessening force required by users for divot repair, should also provide a plurality of other functions to the golfer so as to lessen the tools and implements which need be carried by the user. Still further, to encourage widespread sales in pro shops, and encourage users to take and use the device on trips away from their home course, such a device should allow for replaceable parts which bear indicia whereby the device may be used as a souvenir of play on various courses. Nothing encourages use like the ability to show other players, indicia noting a player's visit to unique or hallowed golfing venues.

In order to lessen the load to the user and thereby encourage use, such a device should provide the functions of the most widely employed additional implements of users, such as a ball marker, a drink opener, and a club support. Additional functions, which will allow the user to minimize the number of components they need carry and maximize their functionality, will serve to encourage use even more by providing a means to encourage taking the device with the user on every golf trek.

With respect to the above, before explaining at least one preferred embodiment of the multiple use divot repair tool herein in detail or in general, it is to be understood that the divot repair tool disclosed herein is not limited in its application to the details of construction and to the arrangement of the components or the steps in the method of its use set forth in the following description or illustrated in the drawings. The divot tool herein is capable of other embodiments, and of being employed in various ways, all of which will be obvious to those skilled in the art once the information herein is reviewed. Also, it is to be understood that the phraseology and terminology employed herein are for the purpose of description and should not be regarded as limiting.

As such, those skilled in the art will appreciate that the conception upon which this disclosure is based, may readily be utilized as a basis for designing a divot repair tool of improved performance and for carrying out the several purposes of the present disclosed device and method. It is important, therefore, that the embodiments, objects and claims herein, be regarded as including such equivalent methodology and operational components insofar as they do not depart from the spirit and scope of the present invention.

SUMMARY OF THE INVENTION

The present device herein disclosed, remedies the aforementioned shortcomings of prior divot repair tools by providing both improved design yielding mechanical advantage as well as a configuration providing multiple uses for other purposes in a simple yet highly functional configuration.

The device features a central body portion having a handle disposed from one edge and two projecting legs extending from the central body portion in a direction opposite the handle. While running along the same line, the handle and the forks both have a central axis which is at an angle to the other and to that of the central body.

The extending legs are adapted at distal ends with a taper to allow them to be inserted into the turf easily by imparting the initial force from pushing the handle to a compact area. An internal taper also provides means for progressive compression of a soft article forced therein such as a cigar. Many golfers like smoking cigars during a round and set them on the green or ground during shots. The burning tobacco causes burn marks in the turf and the grass can cause odd flavors to be imparted to the cigar. Thus a device to temporarily support the burning end of cigar above the turf is something that will be valued by cigar afficionado golfers.

In use to repair a pitch mark, once so inserted under or in the turf, with the distal ends of the forks under the pitch mark, the device combines an angular extension of the forks along with a curved surface at the fork and body intersection, which in combination mechanically, yields a means to provide a mechanical advantage to the user. The placement of curved shoulders on the central body, along with angular extension of the forks and the handle from the body, provide a multiplication of the power imparted by the user forcing the handle end. Thus, in use with the legs inserted into the turf, the curved projecting shoulders of the device raise the handle from the turf and provide a fulcrum to help direct the force of the handle to the task of repairing the pitch mark or divot. This differs greatly from the generally linear configuration of conventional divot repair tools.

Additionally provided to multiply the uses of the device, are a recess in the central body portion adapted to engage one or a plurality of ball markers therein. If the ball markers are thin in construction, a plurality of such markers may be frictionally, adhesively, or otherwise engaged in a cavity formed in the central body portion. Or means of engagement of the ball markers may be magnetic and allow for one or a plurality of markers to be stacked in the central cavity and maintain themselves in this mount until needed. Alternatively one ball marker might be provided of a thicker nature or especially a decorative nature providing an ornamental feature to the device to encourage use as a trophy of sorts, or to customize the device to carry the logo or name of the golf course at which it is sold. This would make the device a souvenir for golfers playing or visiting prestige courses and also encourage use since it will be widely available through sales at many pro shops.

Additional functionality is provided by two types of drink container openers. Golfers tend to travel with sustenance in bottles and cans. Formed into the shoulder of the central body portion, is a pull tab prying component. The component features a slot formed in a face of the body above the forks. The slot is adapted to engage a pull tab and lift it with a rotation of the body portion by a push of the handle portion. This function will be especially favored by golfers who might want to open a can of soda or beer but have long fingernails.

Pull tabs on cans are notoriously hard on fingernails, especially artificial nails that are highly popular with women in industrialized countries. Many a real, or artificial nail, has been torn, chipped, or ruined by a hard to open pull tab. Further, for older users or those with hand ailments making pull tabs hard or painful to open, a device to aid that task would be valued. Thus, the inclusion of a pull tab prying component will encourage use of the device by many golfers.

On the opposite shoulder portion of the body opposite the pull tab opener is located a bottle opener. The bottom end of the bottle opener is provided by the curved shoulder of the body portion and a recess just under the projecting legs. The combination of the overhanging legs and hook portion provide an especially good engagement with bottle caps, and the handle extension provides the leverage to easily remove them. This too will be a function valued by all users especially as it allows them to eliminate the bottle opener from the supplies they must carry.

In addition, the device provides two other functions that may appeal to golfers. On the distal end of the handle, opposite its attachment to the body portion, a curved end portion is adapted to support a club when the forks are engaged in the turf. The curved end is necessary as a means to maintain the club on the end when on a slant, in wind, or with a club that might roll. Without this curve, the club will tend to roll or slide off. Also provided by an inward angle of the distal ends of each fork, is a cigar holder function which is especially useful to many golfers who enjoy a good cigar. Rather than lay the lit cigar on the grass, the user may push the handle into the turf a short distance, and slide the cigar in between the forks. The inward slant of the forks provides means for progressively increasing the compression on the cigar when pushing which helps hold it and is thus preferred.

It is an object of this invention to provide an easily transportable golf divot repair tool which provides a mechanical advantage to the user when repairing a divot.

It is an additional object of this invention to provide such a divot repair tool which also has a plurality of other functions thereby eliminating other tools or components the golfer must carry.

It is yet another object of the invention to provide such a tool that encourages golfers to carry and use it by providing multiple other functions as well as indica rendering it a souvenir giving the user a means to show they have visited prestige courses and thereby encourage carrying and use.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
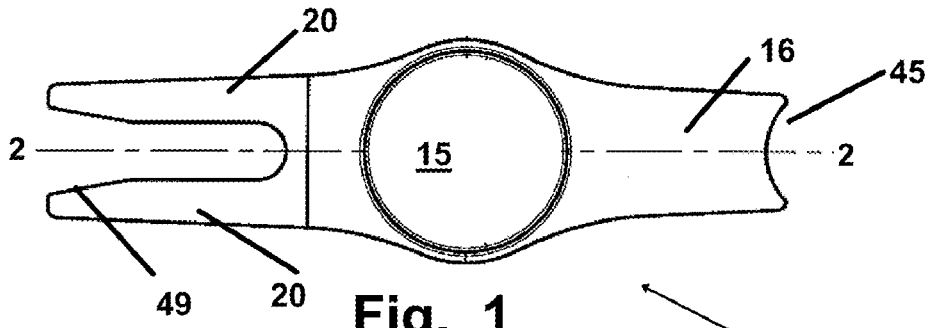
FIG. 1 is a top view of the divot repair tool also showing the cavity holding a ball marker and the curved edge of the handle portion.

Referring now to the drawings in FIGS. 1-12 wherein similar parts are identified by like reference numerals, there is seen in FIG. 1, the top view of the preferred device 10 which is adapted to function especially well as a divot repair tool especially well adapted to provide mechanical advantage to the user in repairing pitch marks.

In the view of FIG. 1, a cavity 15 is shown that is adapted to hold one or a plurality of ball markers 14 therein. The engagement of the ball markers 14 may be frictional or magnetic employ other means to hold them within the cavity 15.

A handle 16 extends in one direction from the body 18 and a pair of legs 20 having tapered distal ends 21 extends opposite the handle 16. In use, the legs 20 are engaged under the pitch mark dent type divot 50 on the turf and the body 18 placed on the ground next to the divot 50. The handle 16 is employed to fix the divot 50 with the combination of shoulders 22 on both sides of the body 18 and angular engagement of the forks 20 and handle 16 with the body 18 providing means to develop mechanical advantage when the handle 16 is rotated.

Figure 2:
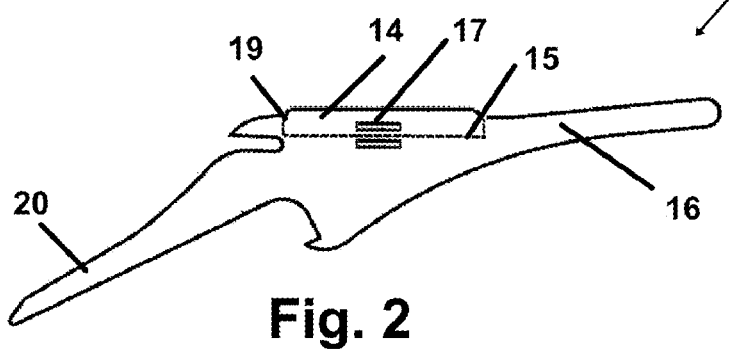
FIG. 2 is a sectional view of the device of FIG. 1 along line 2-2, showing the shoulder portions which provide mechanical advantage and the formed pull tab prying tool and bottle opener and magnetic means of maker engagement.
Figure 7:
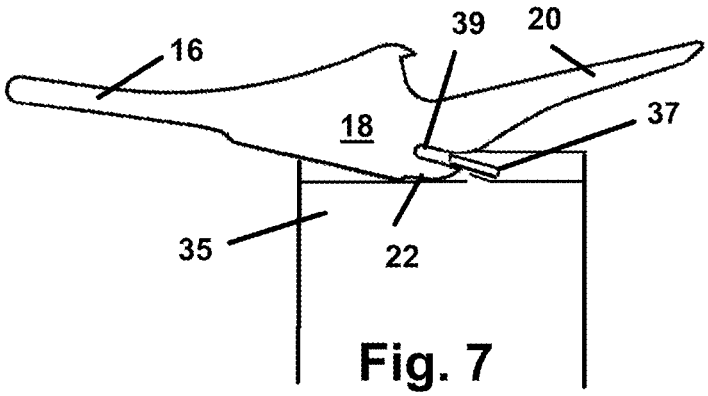
FIG. 7 shows the device opening a pull tab.

Additionally provided, as seen in FIGS. 2 and 7, a pull tab opener 39 is formed into one shoulder 22 portion, and a bottle opener 26, is formed adjacent to the other shoulder 22 to allow the device 10 to not only repair dent or pitch mark type divots 50, and house one or more ball markers 14, but to also aid the user in the opening of beverage containers which are frequently carried for sustenance during a round of golf.

Also seen in FIG. 2, is the ball marker 14 and means of engagement thereof in the cavity 15 depicted as magnets 17 and magnetically attractive components. Frictional engagement of the perimeter of the marker 14 with an edge 19 in the cavity 15 might also be employed for engagement or other means of engagement as would occur to those skilled in the art.

Figure 4:
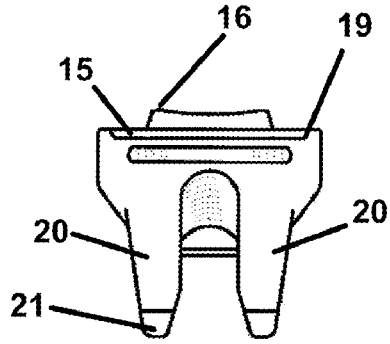
FIG. 4 shows an end view of the device from the distal ends of the forks.
Figure 3:
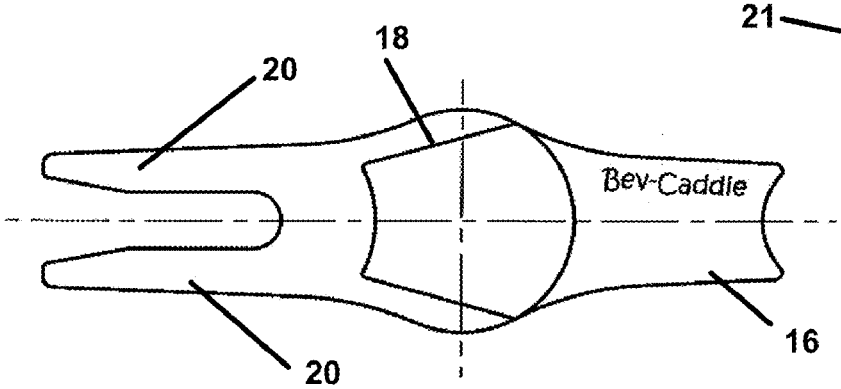
FIG. 3 depicts a bottom view of the device of FIG. 1.

In FIG. 3 there can be seen the device 10 from a bottom view and in FIG. 4 the device 10 is shown from a end view adjacent to the distal ends 21 of the forks 20. Also shown is the cavity 15 and edge 19 of the cavity for holding the perimeter of the ball marker 14.

Figure 5:
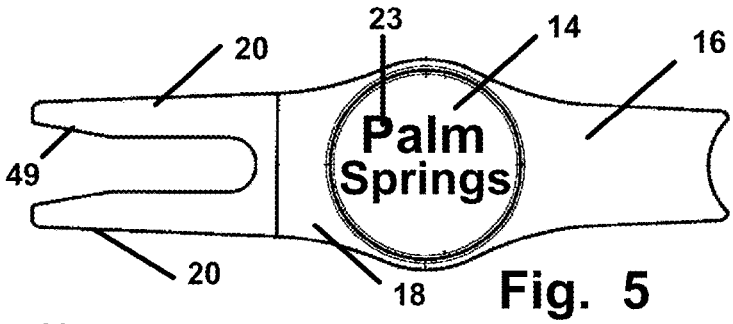
FIG. 5 shows the device of FIG. 1 wherein the ball marker bears indicia memorializing a location or event sponsor.

In FIG. 5, the device 10 is shown with a ball marker 14 engaged in the cavity 15. The marker 14 bears indicia 23 which may be memorializing a local or prestige location, or and event or a may be indicia of a sponsor giving the device 10 away.

Figure 6:
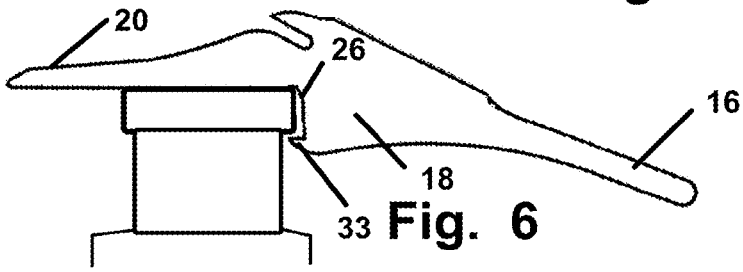
FIG. 6 shows the device opening a bottle cap.

In use to open a bottle, in FIG. 6 the device is shown opening a bottle cap. The bottle opener 26 is formed by a combination of the forks 20 and a ledge 33 adjacent to shoulder 22. The downward angle of the handle 16 when the bottle opener 26 is engaged, makes it easier to hold the bottle 29 while removing the cap and is preferred.

In use to open a can 35 having a pull tab 37, in FIG. 7 there is shown a side view with the pull tab 37 engaged in a slot 39 adapted in size to engage a pull tab 37 when the shoulder 22 is positioned on the top of the can 35. The curved shoulder 22 and upward angle of the handle 16 from the can top, provides increased leverage while holding the can 35, and is thus preferred.

Figure 8:
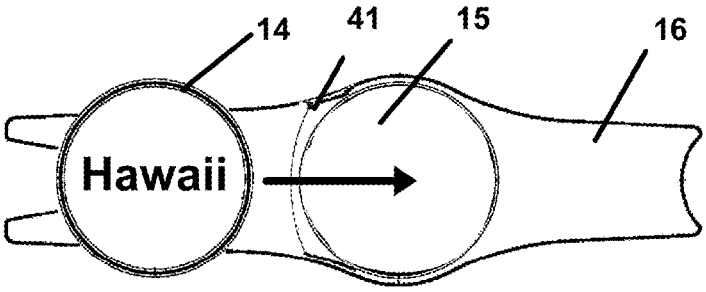
FIG. 8 depicts the insertion of a ball marker through an open end of a cavity adapted to hold the ball markers.
Figure 10:
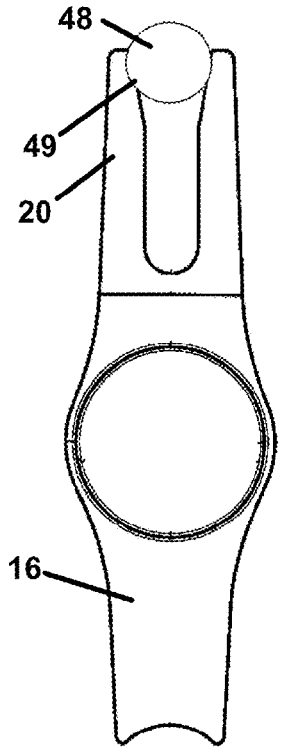
FIG. 10 shows the device engaged to a cigar.

Insertion of the ball marker 14 into the cavity 15 is depicted in FIG. 8. As shown, the ball marker 14 may be slidably engaged by its perimeter against the overhanging edge 19 of the cavity 15, by sliding it therein though an open end 41 of the cavity 15 adapted to hold the ball markers 14. Other means of removable engagement as noted may be employed such as the magnets 17.

Figure 9:
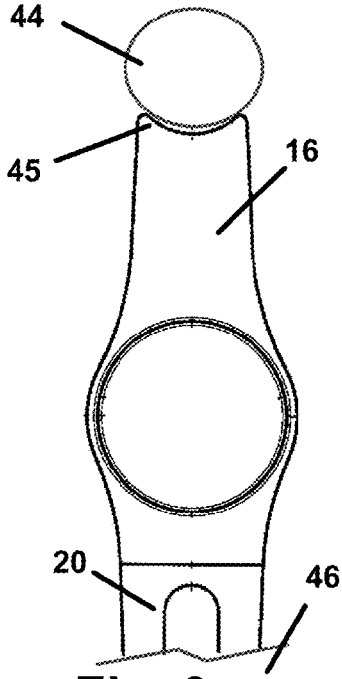
FIG. 9 shows the device supporting a club above the turf.

Holding functions are shown in FIG. 9 which depicts the device 10 supporting a club shaft 44 above the turf 46 in a curved edge 45 support formed to accommodate the curved exterior of a club 44 and maintain it atop the vertically inclined handle 16. Without this curved edge 45 the club shaft 44 may fall from the end of the handle 16 when so elevated so the curved edge 45 is preferred. A secondary holding function is shown by the device in FIG. 10 wherein a cigar 48 may be engaged by compressing it between the forks 20 using the inwardly slanted edges 49. The wide to narrow slant of the edges 49 allow the cigar 48 or other soft component, to be pushed between the forks, and provide a means to progressively compress it therein at an increasing rate as it reaches the narrower portion. This is preferred in order not to damage the exterior of the cigar in use and to better hold the cigar once inserted.

Figure 11:
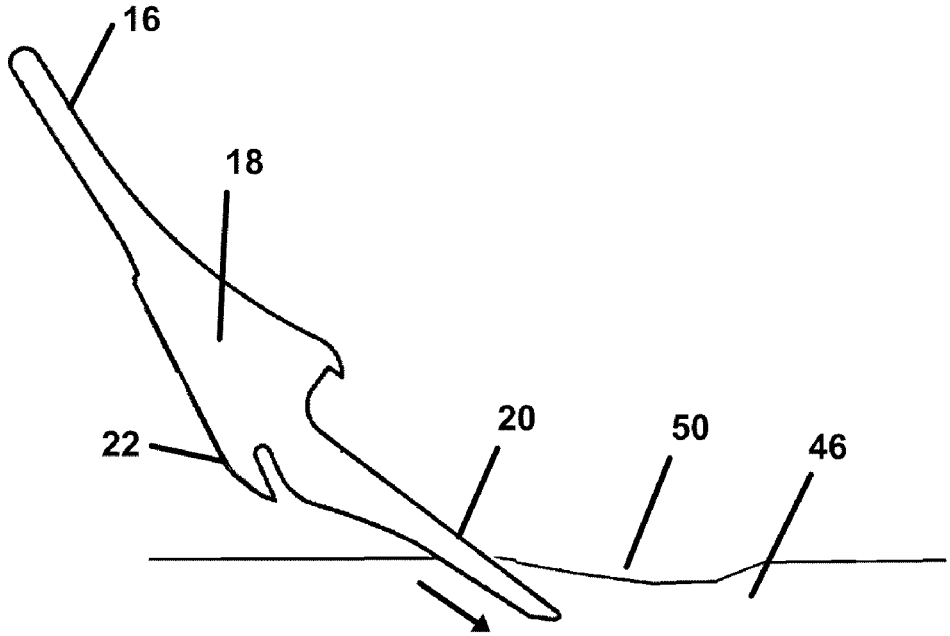
FIG. 11 depicts the insertion of the device adjacent to a divot in the turf.
Figure 12:
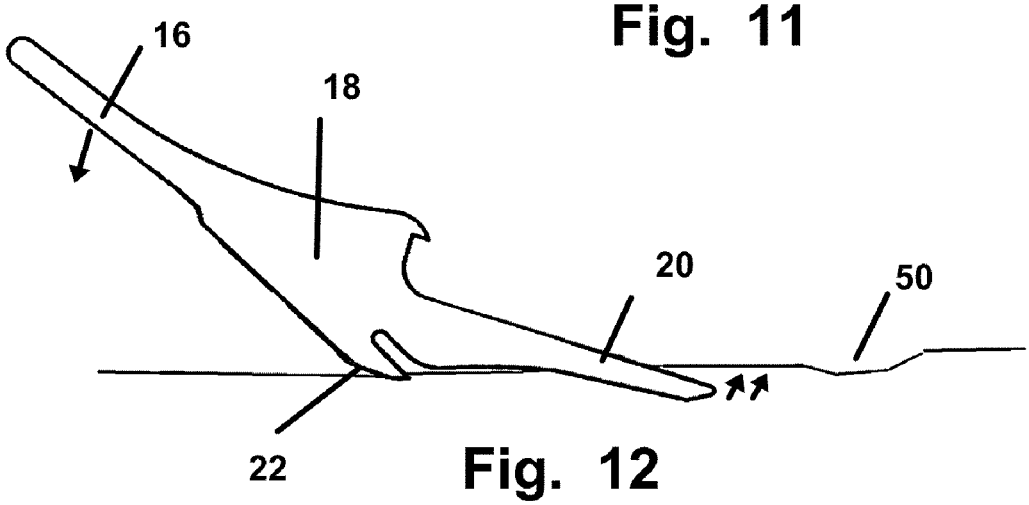
FIG. 12 shows the mechanical advantage provided by the angled fork and body engagement and the curved shoulder allowing for an easy rotation of the body portion.

In use as to repair a pitch mark type divot 50, the device 10 in FIG. 11 is inserted in the turf 46 adjacent to a divot 50. The curved shoulders 22, and the different angular engagements of the handle 16 and forks 20 to the body 18, combine to yield a means for increase mechanical advantage over conventional divot tools consisting of a simple straight axis member. As shown in FIG. 12, this mechanical advantage provided by the angled forks 20 and engagement and the low rolling resistence of the curved shoulder 22 and the raised handle 16 being higher from the turf 46 all combining for increased mechanical advantage to allow for an easy rotation of the body portion 18. The distal end of the handle is higher with this angled engagement also providing additional rotation of the body 18 and forks 20 when engaged to the turf 46 before striking the turf 46.

While all of the fundamental characteristics and features of the golf divot repair tool and multi-use device been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A golf divot repair tool apparatus comprising:

a body portion;

a handle extending along a first axis, from an engagement end at a first end of said body portion, to a distal end;

a pair of parallel members extending from a second end of said body portion from first ends engaged to said body, to distal ends;

edges of said members defining a gap therebetween, said gap extending from said body, along a second axis, in an opposite direction of said handle;

a rounded shoulder positioned on a top surface of said body adjacent to said second end;

a slot formed in said body adjacent to said shoulder;

said slot sized to engage a pull tab of a pop top can;

a rotation of said body with said handle with said slot engaged with said pop top providing means to force an opening of said pop top can;

said members extending in a plane running through said second axis from said body at an extension angle positioning said distal ends below said first axis when said first axis is positioned substantially horizontal; and said rounded shoulder and said extension angle providing means for mechanical advantage when said repair tool is placed in an as-used position, with said members inserted into turf and said shoulder contacting a top surface of said turf, whereby a rotation of said body by a forcing of said handle toward said turf creates an upward force on turf positioned above said members in excess of said downward force.

2. The divot repair tool of claim 1 additionally comprising:

means to removably maintain a golf ball marker to said top surface.

3. The divot repair tool of claim 2 wherein said means to removably maintain a golf ball marker to said top surface comprises:

a recess formed in said top surface;

said recess adapted for placement of said golf ball marker therein; and means to removably maintain said golf ball marker in said recess.

4. The divot repair tool of claim 3 wherein said means to removably maintain said golf ball marker in said recess is a frictional engagement of at least a portion of a perimeter edge of said golf ball marker with a surrounding edge of said recess.

5. The divot repair tool of claim 2 wherein said means to removably maintain said golf ball marker to said top surface is a magnetic attraction between said golf ball marker and said body.

6. The divot repair tool of claim 3 wherein said means to removably maintain said golf ball marker in said recess is a magnetic attraction between said golf ball marker and said body.

7. The divot repair tool of claim 1 additionally comprising:

a notch formed adjacent to said first ends of said members; and said notch, and bottom surfaces of said members forming a bottle opener.

8. The divot repair tool of claim 2 additionally comprising:

a notch formed adjacent to said first ends of said members; and said notch, and bottom surfaces of said members forming a bottle opener.

9. The divot repair tool of claim 3 additionally comprising:

a notch formed adjacent to said first ends of said members; and said notch, and bottom surfaces of said members forming a bottle opener.

10. The divot repair tool of claim 1 additionally comprising:

said distal end of said handle having an arched edge; and said arched edge providing a support for a curved club shaft when said repair tool is placed in said as-used position.

11. The divot repair tool of claim 3 additionally comprising:

said distal end of said handle having an arched edge; and said arched edge providing a support for a curved club shaft when said repair tool is placed in said as-used position.

12. The divot repair tool of claim 3 additionally comprising:

said slot having a widening from a narrowest point to a widest point adjacent to said distal ends of said members; and said widening providing means to progressively impart increased compression upon a cigar pushed into said slot from said widest point towards said narrowest point, whereby said repair tool will engage with said cigar in removably compressive engagement in said slot.

* * * * *